US010047755B2

(12) United States Patent
Tamaoka et al.

(10) Patent No.: US 10,047,755 B2
(45) Date of Patent: Aug. 14, 2018

(54) FAN

(71) Applicant: NIDEC CORPORATION, Kyoto (JP)

(72) Inventors: Takehito Tamaoka, Kyoto (JP); Kazuhiko Fukushima, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 433 days.

(21) Appl. No.: 14/532,183

(22) Filed: Nov. 4, 2014

(65) Prior Publication Data

US 2015/0176587 A1 Jun. 25, 2015

(30) Foreign Application Priority Data

Dec. 20, 2013 (CN) ..... 2013 1 0711369

(51) Int. Cl.

| | |
|---|---|
| ***F04D 25/06*** | (2006.01) |
| ***F04D 29/28*** | (2006.01) |
| ***F04D 29/32*** | (2006.01) |
| ***F04D 29/62*** | (2006.01) |

(52) U.S. Cl.

CPC ..... *F04D 25/0613* (2013.01); *F04D 29/282* (2013.01); *F04D 29/329* (2013.01); *F04D 29/626* (2013.01)

(58) Field of Classification Search

CPC .... F04D 29/263; F04D 29/329; F04D 19/002; F04D 29/66; F04D 29/322

See application file for complete search history.

(56) References Cited

U.S. PATENT DOCUMENTS 2,147,005 A * 2/1939 Williams ..... F04D 29/281 416/175
4,172,678 A * 10/1979 Schonwald ..... F04D 29/263 403/267

(Continued)

FOREIGN PATENT DOCUMENTS

GB 1191705 A * 5/1970 ..... F04D 7/04
JP 2008-69672 A 3/2008

OTHER PUBLICATIONS

Kazmer, David O.. (2007). Injection Mold Design Engineering. Hanser Publishers, Munich, Ch. 2, 4.*

*Primary Examiner* — Peter J Bertheaud
*Assistant Examiner* — Geoffrey Lee
(74) *Attorney, Agent, or Firm* — Westerman, Hattori, Daniels & Adrian, LLP

(57) ABSTRACT

A fan includes a stationary portion; a bearing mechanism; and a rotating portion. The rotating portion includes an impeller including a plurality of blades and an annular impeller cup arranged to support the blades. The rotor portion includes a cover portion and a cylindrical portion. The impeller is fixed to an outer circumferential surface of the cylindrical portion of the rotor portion. The outer circumferential surface of the cylindrical portion and an inner circumferential surface of the impeller cup have a joining portion therebetween. At least one of the outer circumferential surface of the cylindrical portion and the inner circumferential surface of the impeller cup includes a groove portion recessed radially from the joining portion. The groove portion includes an upward facing surface. An adhesive is arranged in the groove portion. At least a portion of the adhesive is arranged above the upward facing surface of the groove portion.

18 Claims, 13 Drawing Sheets

(56) References Cited

U.S. PATENT DOCUMENTS 6,318,964 B1 * 11/2001 Yang ..... B29C 45/006 415/198.1
6,572,336 B2 * 6/2003 Horng ..... F04D 29/023 416/183
6,700,256 B2 * 3/2004 Fukutani ..... G11B 19/2009 310/67 R
7,088,023 B1 * 8/2006 Gomyo ..... F16C 35/02 310/40 R
8,113,715 B2 * 2/2012 Ito ..... F16C 17/107 384/100
8,147,203 B2 * 4/2012 Chen ..... F04D 29/329 415/213.1
8,324,776 B2 * 12/2012 Tamaoka ..... G11B 19/2009 310/90
8,427,779 B2 * 4/2013 Shinji ..... G11B 19/2009 310/67 R
8,638,526 B2 * 1/2014 Shinji ..... G11B 25/043 310/90
8,757,978 B2 * 6/2014 Takeshita ..... F04D 25/0613 416/185
9,350,211 B2 * 5/2016 Tanaka ..... H02K 5/1732
9,366,263 B2 * 6/2016 Tamaoka ..... F04D 25/062
9,636,779 B2 * 5/2017 Chang ..... B23K 26/206
2003/0185681 A1 * 10/2003 Lin ..... B29C 33/005 416/1
2003/0185682 A1 * 10/2003 Lei ..... F04D 29/325 416/183
2003/0185684 A1 * 10/2003 Zhong ..... F04D 29/34 416/210 R
2005/0047920 A1 * 3/2005 Chen ..... F04D 29/0566 416/244 R
2005/0244086 A1 * 11/2005 Murata ..... F16C 17/107 384/91
2007/0014675 A1 * 1/2007 Nagamatsu ..... F04D 29/281 417/354
2008/0024024 A1 * 1/2008 Tamaoka ..... H02K 5/1675 310/90
2008/0063542 A1 * 3/2008 Oguma ..... F04D 25/0613 417/354
2009/0115275 A1 * 5/2009 Higashihara ..... H02K 5/1675 310/90
2009/0155080 A1 * 6/2009 Yu ..... F04D 29/329 416/212 R
2010/0074761 A1 * 3/2010 Yang ..... F04D 29/626 416/244 R
2010/0215505 A1 * 8/2010 Takeshita ..... F04D 25/0613 416/223 R
2010/0232733 A1 * 9/2010 Ito ..... F16C 17/107 384/107
2012/0027571 A1 * 2/2012 Cho ..... F04D 29/023 415/119
2013/0266463 A1 * 10/2013 Kodama ..... F04D 25/0613 417/423.7
2014/0199189 A1 * 7/2014 Tamaoka ..... F04D 25/062 417/354

* cited by examiner

FAN

BACKGROUND OF THE INVENTION

1. Field of the Invention

The present invention relates to a fan for use in a slim electronic device.

2. Description of the Related Art

In recent years, electronic devices, such as notebook personal computers and tablet personal computers, have been becoming thinner and thinner. In addition, such electronic devices have been becoming more and more sophisticated in functionality, causing a considerable increase in generation of heat in the electronic devices. Inside such slim electronic devices, a large number of electronic components are arranged, and a space occupied by air is not large. Therefore, even in the case where components inside such an electronic device do not generate much heat, an increase in a temperature inside the electronic device may not be negligible. Accordingly, a fan is arranged in the electronic device with the view of cooling an interior of the electronic device.

For example, a fan disclosed in JP-A 2008-069672 is structured in such a manner that a plurality of ribs 25 are arranged to project radially inward from an inner circumferential surface of an annular member 23, and a circumferential wall portion of a rotor yoke is press fitted and fixed to a circumferential wall portion of an impeller cup 21 through support members 24, the annular member 23, and the ribs 25.

SUMMARY OF THE INVENTION

Inside a slim electronic device, a large number of electronic components are arranged, and a space in which a fan is arranged is not large. Therefore, it is necessary to reduce the thickness of the fan. A reduction in the thickness of the fan leads to reductions in the axial dimensions of components of the fan, leading to a reduction in the axial dimension of an area over which an impeller and a rotor are fixed to each other. This in turn leads to a reduction in strength with which a rotor yoke and the impeller are fixed to each other, and this may cause the impeller to come off the rotor. Accordingly, there is a demand for a structure which achieves an improvement in strength with which the impeller and the rotor are fixed to each other while achieving a reduction in the thickness of the fan.

The present invention has been conceived to improve strength with which an impeller and a rotor portion are fixed to each other while achieving a reduction in the thickness of a fan.

A fan according to a preferred embodiment of the present invention includes a stationary portion, a bearing mechanism, and a rotating portion. The stationary portion includes a stator. The rotating portion is supported to be rotatable about a central axis extending in a vertical direction with respect to the stationary portion. The rotating portion includes a shaft, a rotor portion fixed to the shaft, and an impeller including a plurality of blades and an annular impeller cup arranged to support the blades. The rotor portion is in a shape of a covered cylinder, and includes a cover portion and a cylindrical portion. The impeller is fixed to an outer circumferential surface of the cylindrical portion of the rotor portion. The outer circumferential surface of the cylindrical portion and an inner circumferential surface of the impeller cup have a joining portion therebetween. At least one of the outer circumferential surface of the cylindrical portion and the inner circumferential surface of the impeller cup includes a groove portion recessed radially from the joining portion. The groove portion includes an upward facing surface. An adhesive is arranged in the groove portion. At least a portion of the adhesive is arranged above the upward facing surface of the groove portion.

The above preferred embodiment of the present invention is able to improve strength with which the impeller and the rotor portion are fixed to each other while achieving a reduction in the thickness of the fan.

The above and other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, specific preferred embodiments of the present invention will be described with reference to the accompanying drawings. It is assumed herein that a direction parallel to a central axis of a fan is referred to by the term "axial direction", "axial", or "axially", that radial directions centered on the central axis of the fan are referred to by the term "radial direction", "radial", or "radially", and that a circumferential direction about the central axis of the fan is referred to by the term "circumferential direction", "circumferential", or "circumferentially". It is also assumed herein that an axial direction is a vertical direction, and that a side on which a cover portion of a rotor portion is arranged with respect to a bearing mechanism is referred to as an upper side. The shape of each member or portion and relative positions of different members or portions will be described based on the above assumptions. It should be noted, however, that the above definitions of the vertical direction and the upper side should not be construed to restrict in any way the orientation of a fan according to any embodiment of the present invention when the fan is manufactured or in use. It is also assumed herein that the terms "inner" and "outer", "inside and "outside", "inward" and "outward", etc., are defined with respect to the radial directions, and that a side on which a stator is arranged with respect to the central axis is referred to as an outer side. The shape of each member or portion and relative positions of different members or portions will be described based on the above assumptions. It should be noted, however, that the above definitions of the terms and the outer side should not be construed to restrict in any way the orientation of a fan according to any embodiment of the present invention when the fan is manufactured or in use.

Figure 1:
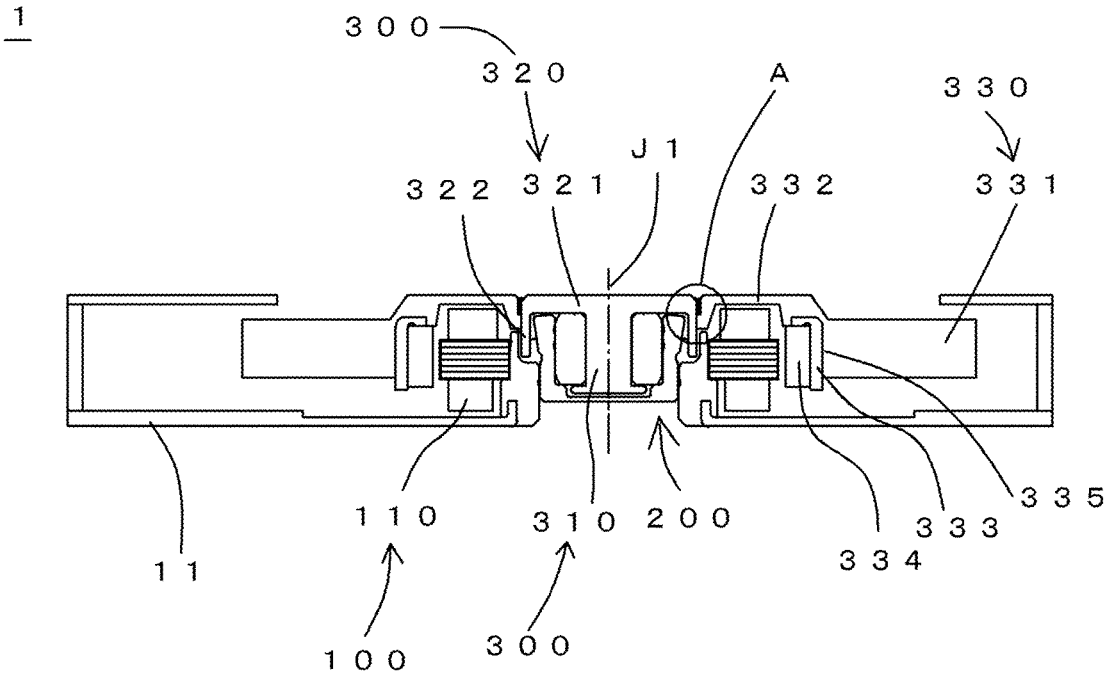
FIG. 1 is a cross-sectional view of a fan according to a preferred embodiment of the present invention.
Figure 2:
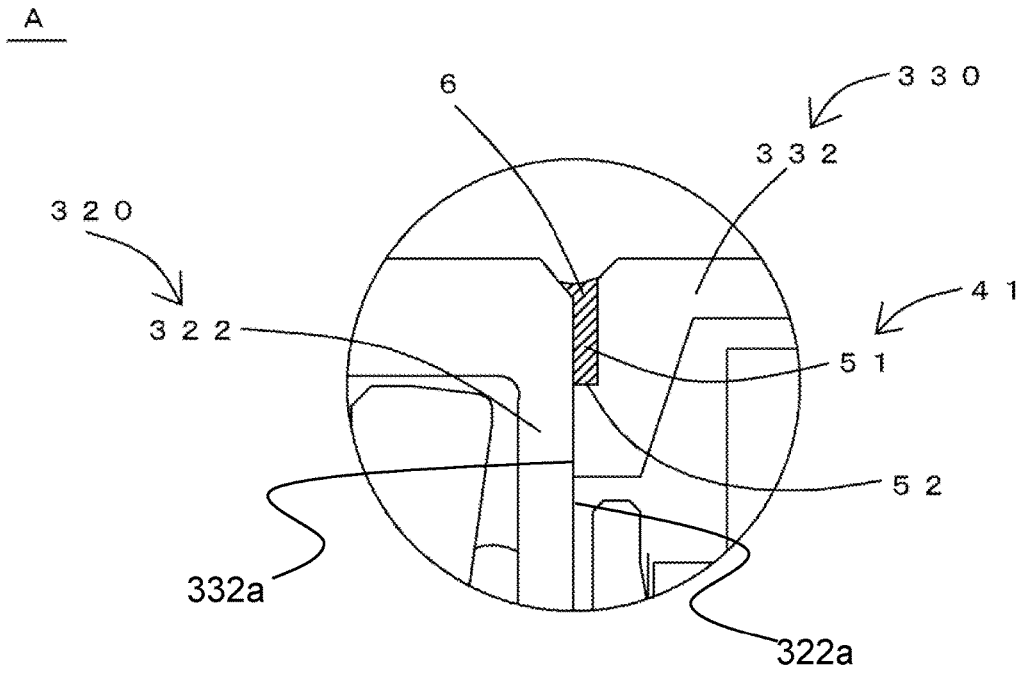
FIG. 2 is a diagram illustrating a portion of the fan denoted by reference symbol "A" in FIG. 1 in an enlarged form.

FIG. 1 is a cross-sectional view of a fan 1 according to a preferred embodiment of the present invention. FIG. 2 is a diagram illustrating a portion of the fan 1 denoted by reference symbol "A" in FIG. 1 in an enlarged form. The fan 1 according to the present preferred embodiment is a centrifugal fan.

Referring to FIGS. 1 and 2, the fan 1 includes a stationary portion 100, a bearing mechanism 200, and a rotating portion 300. The stationary portion 100 includes a stator 110. The rotating portion 300 is supported to be rotatable about a central axis J1 extending in the vertical direction with respect to the stationary portion 100. The rotating portion 300 includes a shaft 310, a rotor portion 320, and an impeller 330. The shaft 310 is arranged to extend along the central axis J1. The rotor portion 320 is defined integrally with the shaft 310, and is arranged to extend radially outward from the shaft 310. The rotor portion 320 and the shaft 310 are arranged to rotate together. A motor (not shown) arranged to rotate the fan 1 includes the stationary portion 100, the bearing mechanism 200, the shaft 310, and the rotor portion 320.

The impeller 330 includes a plurality of blades 331 and an annular impeller cup 332 arranged to support the blades 331. The rotor portion 320 is in the shape of a covered cylinder, and includes a cover portion 321 arranged at a top thereof, and a cylindrical portion 322 arranged to extend axially downward from a radially outer end of the cover portion 321. The impeller 330 is fixed to an outer circumferential surface of the cylindrical portion 322 of the rotor portion 320. In more detail, the impeller cup 332 includes an annular inner circumferential surface, and this inner circumferential surface is fixed to the outer circumferential surface of the cylindrical portion 322 of the rotor portion 320. Referring to FIG. 2, the fan 1 is characterized by including a joining portion 41 between the outer circumferential surface of the cylindrical portion 322 and the inner circumferential surface of the impeller cup 332, and by at least one of the outer circumferential surface of the cylindrical portion 322 and the inner circumferential surface of the impeller cup 332 including groove portions 51 each of which is recessed radially from the joining portion 41. Each groove portion 51 includes an upward facing surface 52, an adhesive 6 is arranged in the groove portion 51, and at least a portion of the adhesive 6 is arranged above the upward facing surface 52 of the groove portion 51. Note that the number of groove portions 51 may be one.

Figure 8:
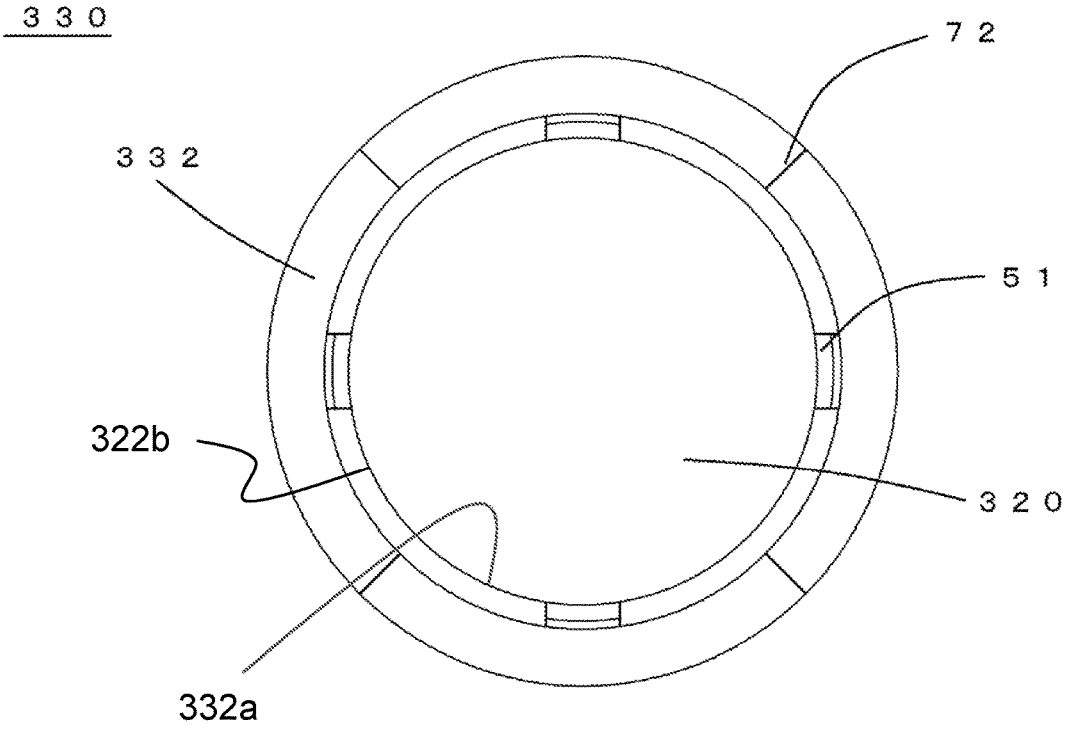
FIG. 8 is a plan view of an impeller cup according to the above preferred embodiment.

Referring to FIG. 2, the joining portion 41 is an area over which the impeller cup 332 and the cylindrical portion 322 are joined to each other by fixing the impeller cup 332 to the cylindrical portion 322 through both press fit and the adhesive 6. In other words, the inner circumferential surface of the impeller cup 332 and an outer circumferential surface of the rotor portion 320 are fixed to each other through press fit, and the adhesive 6 is arranged in each groove portion 51. Note that the joining portion 41 may be an area over which the impeller cup 332 and the cylindrical portion 322 are joined to each other by fixing the impeller cup 332 to the cylindrical portion 322 through only the adhesive 6. As shown in FIGS. 2 and 8, the impeller 330 is fixed to the rotor portion such that an entire circumference 322*b* of an outer circumferential surface 322*a* of the cylindrical portion 322 of the rotor portion 320 is press-fitted with the innermost surface 332*a* of the annular impeller cup 332.

Each groove portion 51 is defined in the annular inner circumferential surface of the impeller cup 332. That is, in an annular inner circumference of the impeller cup 332, each groove portion 51 is recessed radially outward from the joining portion 41. Note that each groove portion 51 may be defined in an annular outer circumferential surface of the cylindrical portion 322 of the rotor portion 320. That is, each groove portion 51 may be recessed radially inward from the joining portion 41 in the outer circumferential surface of the cylindrical portion 322. Also note that each of the inner circumferential surface of the impeller cup 332 and the outer circumferential surface of the cylindrical portion 322 may include the groove portions 51.

According to the present preferred embodiment, the groove portions 51 each of which is recessed radially outward are defined in the inner circumferential surface of the impeller cup 332, and each groove portion 51 includes the upward facing surface 52. Further, at least a portion of the adhesive 6 is arranged above the upward facing surface 52. Since at least a portion of the adhesive 6 is arranged above the upward facing surface 52, the adhesive 6 can be arranged in the groove portion 51 when the impeller 330 and the rotor portion 320 are fixed to each other through the adhesive 6. Further, since at least a portion of the adhesive 6 is arranged above the upward facing surface 52 of each groove portion 51, the adhesive 6 is formed in a wedge shape. This contributes to improving strength with which the impeller 330 and the rotor portion 320 are fixed to each other, and to effectively preventing the impeller 330 from coming off the rotor portion 320.

Referring to FIG. 1, the impeller 330 includes a cup cylindrical portion 335 arranged radially outside the impeller cup 332 to support root portions of the blades 331. A cylindrical "rotor magnet holding member" 333 made of a metal is fixed to a radially inner side of the cup cylindrical portion 335, and a rotor magnet 334 is fixed to a radially inner circumferential surface of the rotor magnet holding member 333. The rotor magnet 334 is preferably a neodymium bonded magnet, but may be a ferrite magnet. The rotor magnet 334 is fixed to the inner circumferential surface of the rotor magnet holding member 333 through press fit or adhesion. The rotor magnet 334 is arranged radially opposite the stator 110. The stator 110 includes a core defined by laminated silicon steel sheets, and coils wound around the core. Each of the coils is defined by a copper wire or an aluminum wire. Once electricity is supplied to the coils, a magnetic field is generated radially outside the stator 110, and this magnetic field interacts with a magnetic field of the rotor magnet 334 to generate a torque to rotate the impeller 330. Once the impeller 330 starts rotating, an axial air current and/or a circumferential air current are generated around the blades 331 to realize a heat dissipation effect of the fan 1.

The fan 1 further includes a fan housing 11 arranged to surround the blades 331. According to the present preferred embodiment, the fan housing 11 is directly fixed to the stationary portion 100. Note that the fan housing 11 may be indirectly fixed to the stationary portion 100 through another member. Also note that the fan housing 11 and the stationary portion 100 may be defined integrally with each other as a single unitary body. The fan housing 11 is defined by bending a metal sheet. Note that the fan housing 11 may be made of a resin material. The fan housing 11 includes an air inlet (not shown) on one axial side, and also includes an air outlet which opens radially outward. According to the present preferred embodiment, the air inlet (not shown) is arranged above the rotor portion 320 and the impeller 330, is arranged to cover an upper side of the impeller 330, and is arranged to pass through in the vertical direction. The air inlet (not shown) is substantially circular, and is arranged to overlap with the central axis J1. Note that the air inlet (not shown) may be arranged below the impeller 330, and arranged to axially overlap with the impeller 330. Also note that air inlets (not shown) may be arranged both above and below the impeller 330.

Referring to FIG. 2, in the fan 1 according to the present preferred embodiment, the groove portions 51, which are more than one in number, are defined in the outer circumferential surface of the cylindrical portion 322 or in the inner circumferential surface of the impeller cup 332. Preferably, the groove portions 51 are arranged at a substantially constant angular pitch in a circumferential direction. The plurality of the groove portions 51 contributes to further improving the strength with which the impeller 330 and the rotor portion 320 are fixed to each other. Note that, since the plurality of groove portions 51 are arranged at a substantially constant angular pitch in the circumferential direction, rotation balance of the impeller 330 is improved, and an air volume characteristic of the fan 1 is also improved.

The impeller 330 of the fan 1 according to the present preferred embodiment is made of a resin material, and is formed by an injection molding process. The impeller 330 can be formed with high precision if the impeller 330 is formed by the injection molding process using molds. In addition, when the molds are used, the impeller 330 can be easily shaped, and a production cost thereof can be reduced. Further, when the impeller 330 is made of the resin material, the weight of the impeller 330 is smaller than in the case where the impeller 330 is made of a metal, and the rotation rate of the impeller 330 can therefore be increased with the same power, leading to an improvement in cooling performance.

As described above, the inner circumferential surface of the impeller cup 332 and the outer circumferential surface of the rotor portion 320 are fixed to each other through press fit, and the adhesive 6 is arranged in each groove portion 51. Since the impeller 330 is fixed to the rotor portion 320 through both press fit and the adhesive 6, an improvement in the strength with which the impeller 330 is fixed to the rotor portion 320 is achieved, and this contributes to preventing the impeller 330 from coming off the rotor portion 320.

Figure 3:
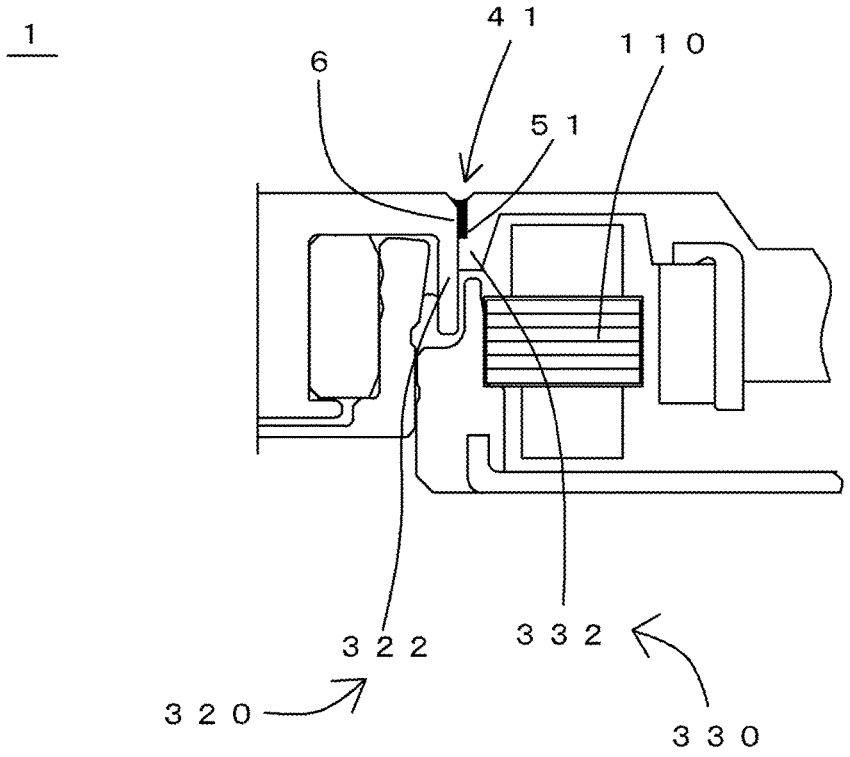
FIG. 3 is a cross-sectional view illustrating a stator and its vicinity according to the above preferred embodiment.

FIG. 3 is a diagram illustrating a portion of the fan 1 in an enlarged form. Referring to FIG. 3, the joining portion 41 is arranged radially inward of the stator 110. Dimensional control of a radial gap between the impeller cup 332 and the cylindrical portion 322 at the joining portion 41 is made easier by arranging the joining portion 41 radially inward of the stator 110. The smaller the gap is in width, the more completely the gap is filled with the adhesive 6, and the strength with which the impeller 330 is fixed to the rotor portion 320 is increased. Therefore, arranging the joining portion 41 radially inward enables the gap between the impeller 330 and the rotor portion 320 to be more completely filled with the adhesive 6, and leads to an improvement in the strength with which the impeller 330 is fixed to the rotor portion 320.

Fixture through both press fit and the adhesive 6 achieves a greater fixing strength than fixture through only press fit. The more radially outward a position at which the impeller 330 and the rotor portion 320 are fixed to each other is, the greater the dimensional tolerance of the gap between the impeller 330 and the rotor portion 320 becomes. Accordingly, the gap between the impeller 330 and the rotor portion 320 may not be filled with the adhesive 6, and the strength with which the impeller 330 and the rotor portion 320 are fixed to each other may become so low that the impeller 330 may come off the rotor portion 320. Moreover, when the dimensional tolerance of the gap between the impeller 330 and the rotor portion 320 is great, concentricity of the impeller 330 may deteriorate to make it difficult for the impeller 330 to rotate stably. According to the present preferred embodiment, the joining portion 41 between the impeller 330 and the rotor portion 320 is arranged radially inward to facilitate the dimensional control of the gap between the impeller 330 and the rotor portion 320. The smaller the gap is in width, the more completely the gap is filled with the adhesive 6, and the strength with which the impeller 330 is fixed to the rotor portion 320 is increased. Therefore, arranging the joining portion 41 between the impeller 330 and the rotor portion 320 radially inward enables the gap between the impeller 330 and the rotor portion 320 to be more completely filled with the adhesive 6, and leads to an improvement in the strength with which the impeller 330 is fixed to the rotor portion 320.

In addition, arranging the joining portion 41 between the impeller 330 and the rotor portion 320 radially inward contributes to improving the concentricity of the impeller 330, and to stable rotation of the impeller 330. Accordingly, the fan 1 is able to achieve an improvement in the air volume characteristic.

Further, since an inner circumferential surface of the impeller 330 includes the plurality of groove portions 51 each of which is recessed radially outward, a wedge effect is produced with respect to the adhesive 6, and the strength with which the impeller 330 and the rotor portion 320 are fixed to each other is further improved.

Figure 4:
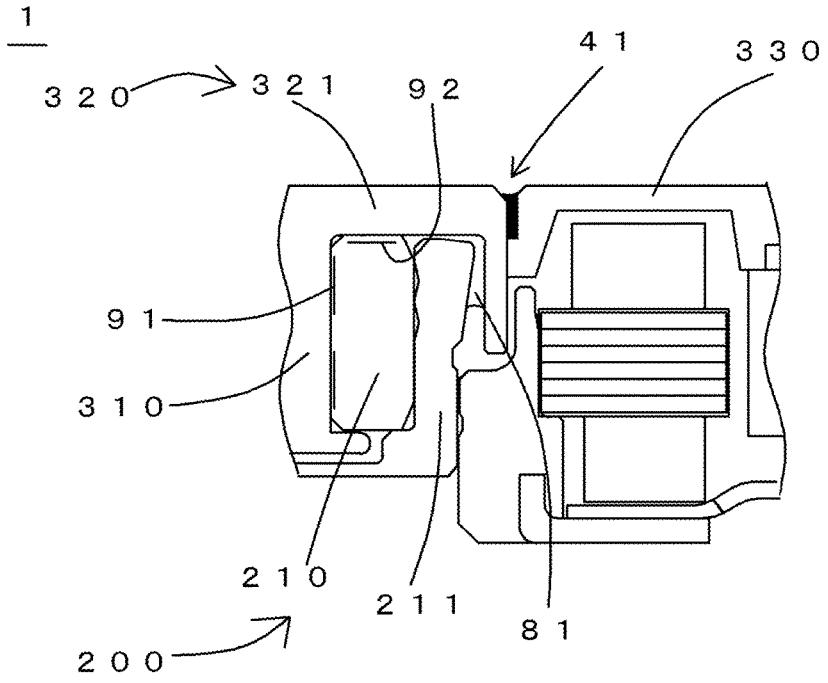
FIG. 4 is a cross-sectional view illustrating a bearing mechanism and its vicinity according to the above preferred embodiment.

FIG. 4 is a diagram illustrating a portion of the fan 1 in an enlarged form. Referring to FIG. 4, the bearing mechanism 200 includes a cylindrical bearing portion 210 centered on the central axis J1, a bearing housing 211 having a bottom and being cylindrical, and arranged to support the bearing portion 210, and a lubricating oil (not shown) arranged in a gap defined between the stationary portion 100 and rotating portion 300. A seal portion 81 is defined between the bearing housing 211 and the rotor portion 320, and a surface of the lubricating oil (not shown) is located in the seal portion 81. The seal portion 81 is arranged radially inward of the joining portion 41.

Since the bearing housing 211 has the bottom and is cylindrical, the amount of the lubricating oil in the bearing mechanism 200 can be improved, the degree of lubrication of the bearing portion 210 and the shaft 310 can be improved, and a life of the fan 1 can also be improved.

Since the seal portion 81 is defined between the bearing housing 211 and the rotor portion 320, and the surface of the lubricating oil is located in the seal portion 81, a reduction in evaporation of the lubricating oil is achieved. In particular, in the case where the fan 1 is arranged in the vicinity of a heat source inside an electronic device, heat from the heat source will increase the evaporation of the lubricating oil. According to the present preferred embodiment, since the surface of the lubricating oil is located in the seal portion 81, a reduction in the evaporation of the lubricating oil is achieved, and the life of the fan 1 is improved.

Since the seal portion 81 is arranged radially inward of the joining portion 41, the likelihood that the lubricating oil will leak out of the bearing mechanism 200 is reduced. In addition, the likelihood that dust or the like will enter into the seal portion 81 is also reduced, reducing the likelihood that dust will enter into the lubricating oil, and this reduces the likelihood that dust will intrude into a gap between the shaft 310 and the bearing portion 210 to cause a locking of the fan 1. In addition, in the case where the impeller 330 is made of the resin material, rotation of the impeller 330 produces static electricity on the impeller 330, and dust is easily attached to the impeller 330 due to the static electricity. Since the seal portion 81 is arranged radially inward of the joining portion 41, the likelihood that dust which has been attached to the impeller 330 due to the static electricity will intrude into an interior of the bearing portion 200 is reduced, so that the bearing portion 210 and the shaft 310 can be protected.

The bearing portion 210 according to the present preferred embodiment is a sleeve made of a sintered material. Using the sintered material for the sleeve contributes to increasing the amount of the lubricating oil held inside the bearing mechanism 200, and to improving the life of the fan 1.

At least one of an outer circumferential surface of the shaft 310 and an inner circumferential surface of the bearing portion 210 includes a radial dynamic pressure generation portion 91. According to the present preferred embodiment, the radial dynamic pressure generation portion 91 is defined in the inner circumferential surface of the bearing portion 210. The radial dynamic pressure generation portion 91 is arranged to radially overlap with the joining portion 41. The radial dynamic pressure generation portion 91 is an array of grooves arranged in a herringbone pattern and defined in the inner circumferential surface of the bearing portion 210 by a cutting process or electrochemical machining. Arranging the radial dynamic pressure generation portion 91 to radially overlap with the joining portion 41 contributes to securing a sufficient axial dimension of the radial dynamic pressure generation portion 91 while securing a sufficient axial dimension of the joining portion 41, and thereby enables the fan 1 to have stability while being slim. Note that the radial dynamic pressure generation portion 91 may be defined in the outer circumferential surface of the shaft 310. Also note that the radial dynamic pressure generation portion 91 may be defined in each of the inner circumferential surface of the bearing portion 210 and the outer circumferential surface of the shaft 310. Also note that the radial dynamic pressure generation portion 91 may not necessarily be the array of grooves arranged in the herringbone pattern, but may be an array of grooves arranged in a spiral pattern.

At least one of a lower surface of the cover portion 321 and an upper surface of the bearing portion 210 includes a thrust dynamic pressure generation portion 92. According to the present preferred embodiment, the thrust dynamic pressure generation portion 92 is defined in the upper surface of the bearing portion 210. The thrust dynamic pressure generation portion 92 is arranged to radially overlap with the joining portion 41. The thrust dynamic pressure generation portion 92 is an array of grooves arranged in a herringbone pattern and defined in the upper surface of the bearing portion 210 by a cutting process or electrochemical machining. Arranging the thrust dynamic pressure generation portion 92 to radially overlap with the joining portion 41 enables the thrust dynamic pressure generation portion 92 to be provided while securing a sufficient axial dimension of the joining portion 41, and thereby enables the fan 1 to have stability while being slim. Note that the thrust dynamic pressure generation portion 92 may be defined in the lower surface of the cover portion 321 of the rotor portion 320. Also note that the thrust dynamic pressure generation portion 92 may be defined in each of the upper surface of the bearing portion 210 and the lower surface of the cover portion 321. Also note that the thrust dynamic pressure generation portion 92 may not necessarily be the array of grooves arranged in the herringbone pattern, but may be an array of grooves arranged in a spiral pattern.

Figure 5:
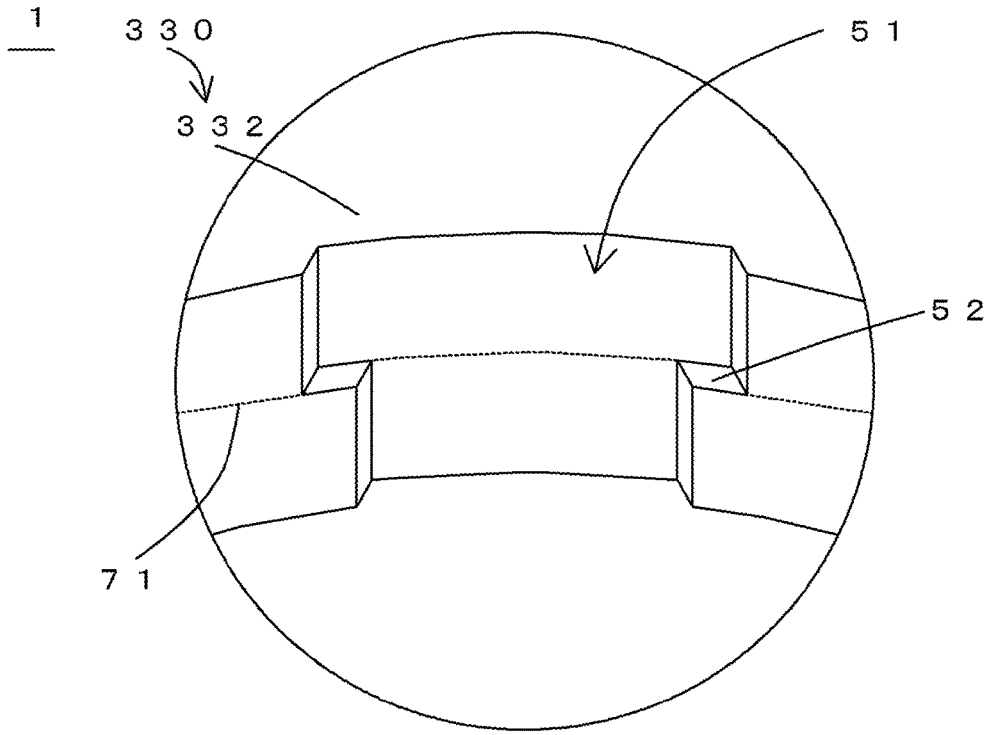
FIG. 5 is a diagram illustrating a groove portion according to the above preferred embodiment in an enlarged form.
Figure 6:
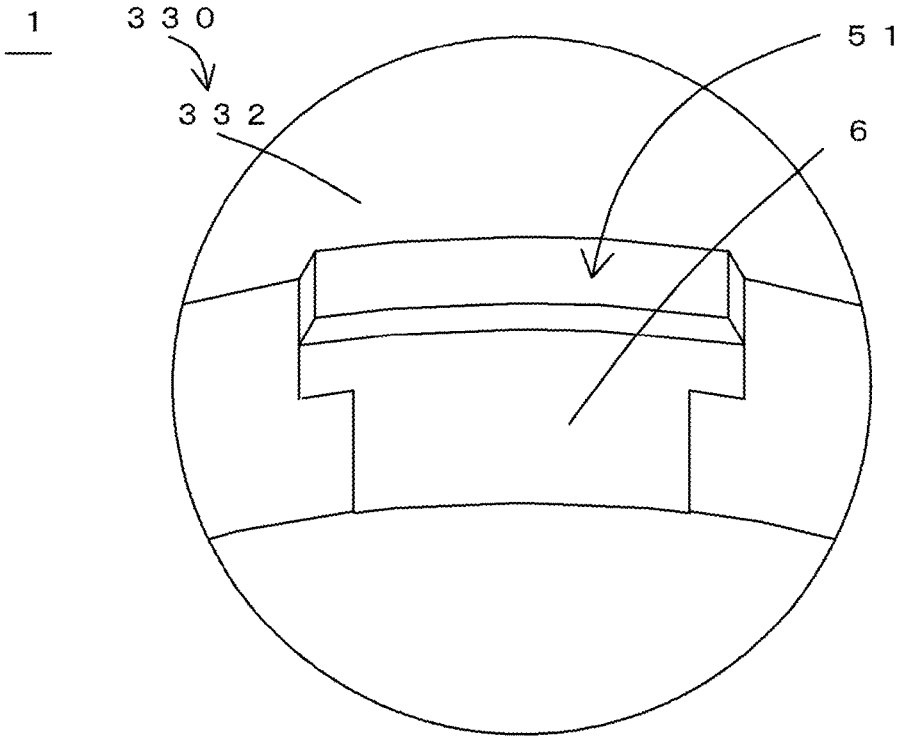
FIG. 6 is a diagram illustrating the groove portion of the fan according to the above preferred embodiment with an adhesive arranged in the groove portion in an enlarged form.

FIG. 5 is a diagram illustrating the groove portion 51 of the fan 1 according to the present preferred embodiment in an enlarged form. FIG. 6 is a diagram illustrating the groove portion 51 of the fan 1 according to the present preferred embodiment with the adhesive 6 arranged in the groove portion 51 in an enlarged form. Referring to FIGS. 5 and 6, a portion of the adhesive 6 is arranged axially above the upward facing surface 52 of the groove portion 51. The upward facing surface 52 of the groove portion 51 is arranged to extend in the circumferential direction. Since the upward facing surface 52 of the groove portion 51 is arranged to extend in the circumferential direction, an increase in the amount of the adhesive 6 arranged above the upward facing surface 52 is achieved. In addition, a wedge structure of the adhesive 6 is formed in the groove portion 51, and this improves the strength with which the impeller 330 and the rotor portion 320 are fixed to each other. Moreover, an increase in the circumferential extent of the upward facing surface 52 contributes to reducing the radial dimension of the impeller cup 332. Thus, miniaturization of the fan 1 can be accomplished.

When the impeller 330 is formed by the injection molding process using the resin material, a parting line 71 is defined between upper and lower molds. The parting line 71 is defined in the inner circumferential surface of the impeller 330. In the groove portion 51, a portion of the parting line 71 is located at a position where the groove portion 51 has a minimum circumferential width. A portion of the adhesive 6 is arranged above the parting line 71. According to the present preferred embodiment, the parting line 71 and the upward facing surface 52 of the groove portion 51 are arranged at the same axial level. When at least a portion of the adhesive 6 is arranged above the upward facing surface 52, the adhesive 6 assumes the wedge shape in the groove portion 51 when being cured. Accordingly, the adhesive 6 is formed in the wedge shape while having an increased axial dimension, and this leads to an additional improvement in the strength with which the impeller 330 and the rotor portion 320 are fixed to each other, and contributes to preventing the impeller 330 from coming off the rotor portion 320.

Arranging a portion of the parting line 71 to be defined at the position where the groove portion 51 has the minimum circumferential width in the groove portion 51 makes it possible to define the groove portion 51 so as to have a wedge structure by a single injection molding process. Accordingly, strength with which the impeller 330 and the rotor portion 320 stick to each other in the axial direction can be improved by the wedge structure of the adhesive 6 arranged in the groove portion 51, and the impeller 330 can be more effectively prevented from coming off the rotor portion 320. Moreover, since the groove portion 51 can be defined so as to have the wedge structure by the single injection molding process, it is possible to improve the strength with which the impeller 330 and the rotor portion 320 stick to each other in the axial direction while holding down a cost needed to define the impeller 330.

Note that the position of the parting line 71 may be modified as long as a portion of the parting line 71 is located at the position where the groove portion 51 has the minimum circumferential width in the groove portion 51. That is, it is possible to adjust the position of the upward facing surface 52 and control the amount of the adhesive 6 arranged in the groove portion 51 by adjusting the position of the parting line 71 when molding the impeller 330 using the molds, and it is thus possible to reduce an increase in the amount of the adhesive 6 used while securing sufficient strength with which the impeller 330 and the rotor portion 320 are fixed to each other.

While the impellers 330 are produced in large quantities, corner portions of the molds are gradually worn with passage of time. If the corner portions of the molds are worn, a gap is defined between the upper and lower molds, without contact portions thereof being in close contact with each other, when the upper and lower molds have been fitted to each other. Then, once the resin material is poured into a cavity between the upper and lower molds when the impeller 330 is molded, the resin material flows into the aforementioned gap, and after removal of the upper and lower molds, the resin material in the gap becomes a protruding portion which protrudes in the circumferential direction. That is, the protruding portion (i.e., a burr) is defined on the parting line 71. In other words, the protruding portion is defined at the position where the groove portion 51 has the minimum circumferential width. The protruding portion defined on the parting line 71 produces the wedge effect when the adhesive 6 has been arranged in the groove portion 51. This contributes to further improving the strength with which the impeller 330 and the rotor portion 320 are fixed to each other, and to preventing the impeller 330 from coming off the rotor portion 320.

Figure 7:
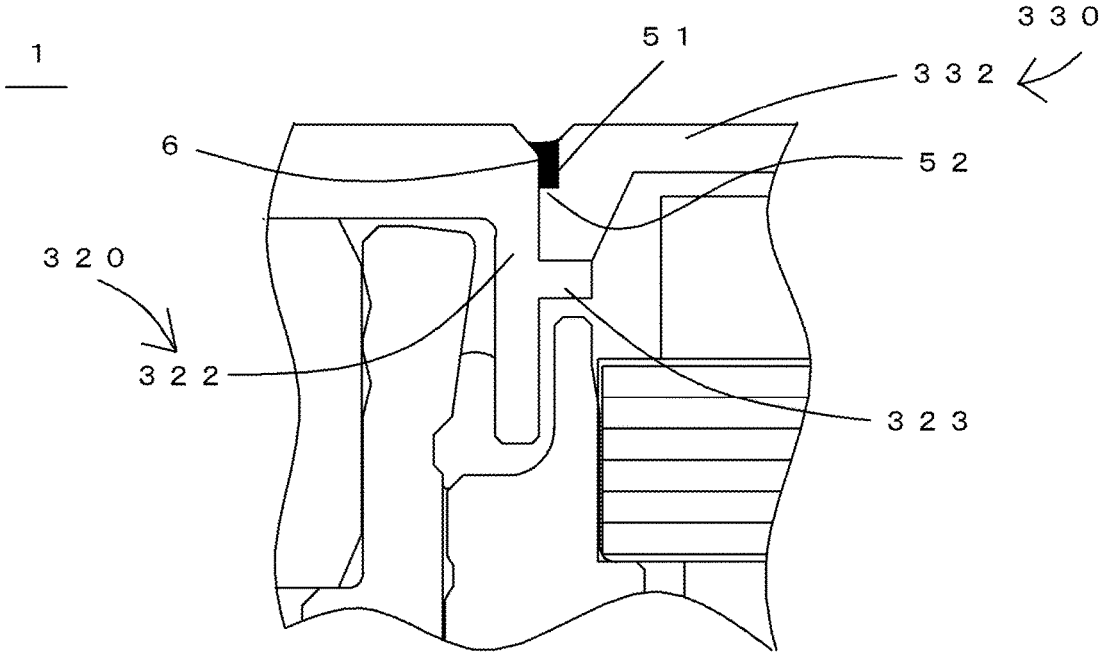
FIG. 7 is a cross-sectional view illustrating a rotor portion and its vicinity according to the above preferred embodiment.

FIG. 7 is a diagram illustrating a portion of the fan 1 according to the present preferred embodiment in an enlarged form. Referring to FIG. 7, the rotor portion 320 further includes, at a radially outer end of the cylindrical portion 322, a flange portion 323 arranged to project radially outward. The upward facing surface 52 of each groove portion 51 is arranged axially above the flange portion 323. The flange portion 323 contributes to preventing the impeller 330 from coming off downward. Once the adhesive 6 is arranged inside the groove portion 51, the wedge structure of the adhesive 6 is formed above the upward facing surface 52 of the groove portion 51, and the impeller 330 is thereby prevented from coming off upward as well. According to the present preferred embodiment, the flange portion 323 and the wedge structure of the adhesive 6 combine to fix the impeller cup 332 in the vertical direction, preventing the impeller cup 332 from moving upward or downward, and to increase the strength with which the impeller 330 and the rotor portion 320 are fixed to each other, and to securely prevent the impeller 330 from coming off the rotor portion 320. Note that the impeller 330 may include, at a radially inner end of the impeller cup 332, a flange portion 323 (not shown) arranged to project radially inward. In this case, the upward facing surface 52 of each groove portion 51 is arranged axially below the flange portion 323. In the case where the impeller 330 is arranged to include the flange portion 323, the impeller 330 is arranged to further include an axial through hole to enable removal of molds when the impeller 330 is molded using the resin material.

FIG. 8 is a plan view of the impeller cup 332 according to the present preferred embodiment of the present invention. Referring to FIG. 8, when the impeller 330 is molded by successive injections of the resin material, a plurality of weld lines 72 are defined on an upper surface of the impeller cup 332. These weld lines 72 are arranged at different circumferential positions from those of the groove portions 51. That is, the groove portions 51 are defined at circumferential positions where no weld lines 72 are defined. When the impeller 330 is fixed to the rotor portion 320 through press fit, the greatest stress is applied to each weld line 72. Therefore, if each groove portion 51 were defined at a position where any weld line 72 is defined, the impeller 330 might be easily broken because the weld line 72, to which the greatest stress is applied, would have a decreased radial dimension. According to the present preferred embodiment, each groove portion 51 is arranged at a position where no weld line 72 is defined, and this contributes to preventing the impeller 330 from being broken when the impeller 330 is fixed to the rotor portion 320 through press fit. Note that the plurality of weld lines 72 may be evenly distributed along the circumferential direction on the upper surface of the impeller cup 330. Also note that, in the case where the plurality of groove portions 51 are defined, the groove portions 51 may be evenly distributed along the circumferential direction such that the groove portions 51 and the weld lines 72 are arranged at different circumferential positions.

Figure 9:
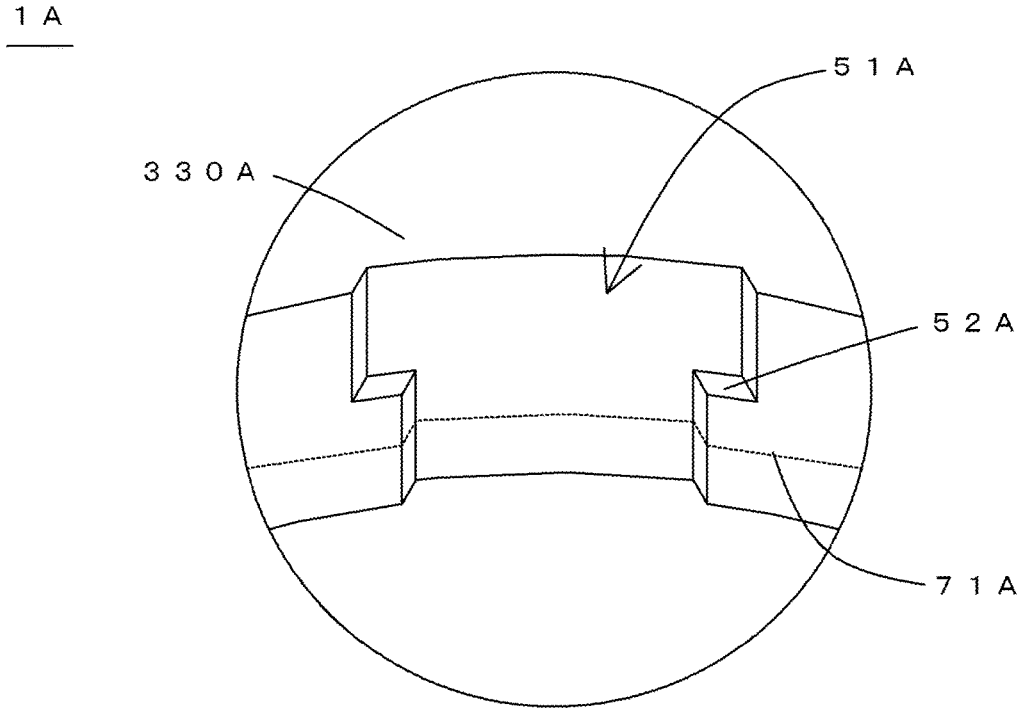
FIG. 9 is a diagram illustrating a groove portion according to an example modification of the above preferred embodiment in an enlarged form.

FIG. 9 is a diagram illustrating a groove portion 51A of a fan 1A according to an example modification of the above-described preferred embodiment in an enlarged form. The basic structure of the fan 1A according to this example modification is the same as that of the fan 1 according to the above-described preferred embodiment. Referring to FIG. 9, an upward facing surface 52A of the groove portion 51A is arranged axially above a parting line 71A. As suggested above, a protruding portion which protrudes in the circumferential direction is defined on the parting line 71A due to wear of corner portions of molds when an impeller 330A is molded using a resin material. Since the upward facing surface 52A of the groove portion 51A is arranged axially above the parting line 71A, an adhesive (not shown) forms a wedge shape at the protruding portion on the parting line 71A, producing a wedge effect. Further, because a portion of the adhesive (not shown) is placed above the upward facing surface 52A of the groove portion 51A to produce an additional wedge effect, a further improvement in strength with which the impeller 330A and a rotor portion 320A are fixed to each other is achieved to reduce the likelihood that the impeller 330A will come off the rotor portion 320A.

Figure 10:
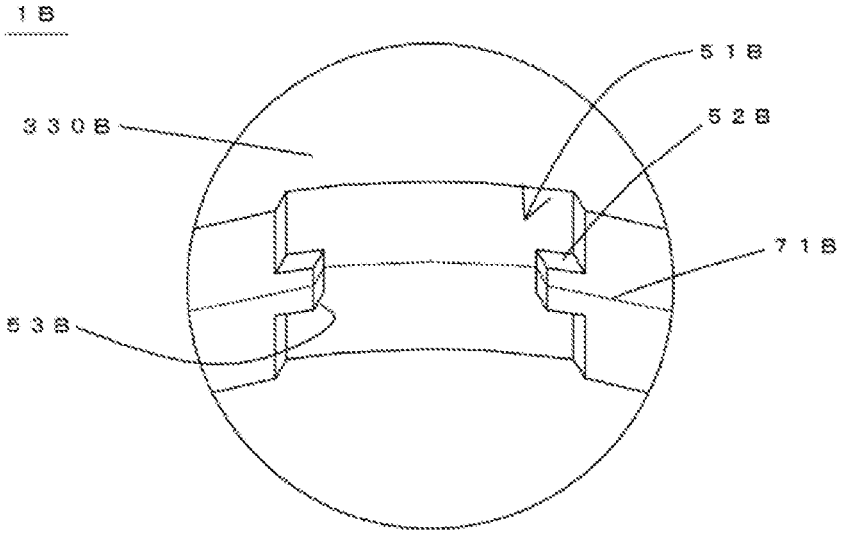
FIG. 10 is a diagram illustrating a groove portion according to another example modification of the above preferred embodiment in an enlarged form.

FIG. 10 is a diagram illustrating a groove portion 51B of a fan 1B according to another example modification of the above-described preferred embodiment in an enlarged form. The basic structure of the fan 1B according to this example modification is the same as that of the fan 1 according to the above-described preferred embodiment. Referring to FIG. 10, the groove portion 51B includes a downward facing surface 53B in addition to an upward facing surface 52B arranged axially above a parting line 71B. The downward facing surface 53B is arranged axially below the parting line 71B. That is, the upward facing surface 52B and the downward facing surface 53B are defined, respectively, axially above and below the parting line 71B when an impeller 330B is injection-molded using molds. Once an adhesive (not shown) is arranged in the groove portion 51B, at least a portion of the adhesive (not shown) is placed above the upward facing surface 52B. Accordingly, wedge structures of the adhesive (not shown) are formed both axially above and below the parting line 71B. Thus, a further improvement in strength with which the impeller 330B and a rotor portion 320B are fixed to each other is achieved to more effectively prevent the impeller 330B from coming off the rotor portion 320B.

Figure 11:
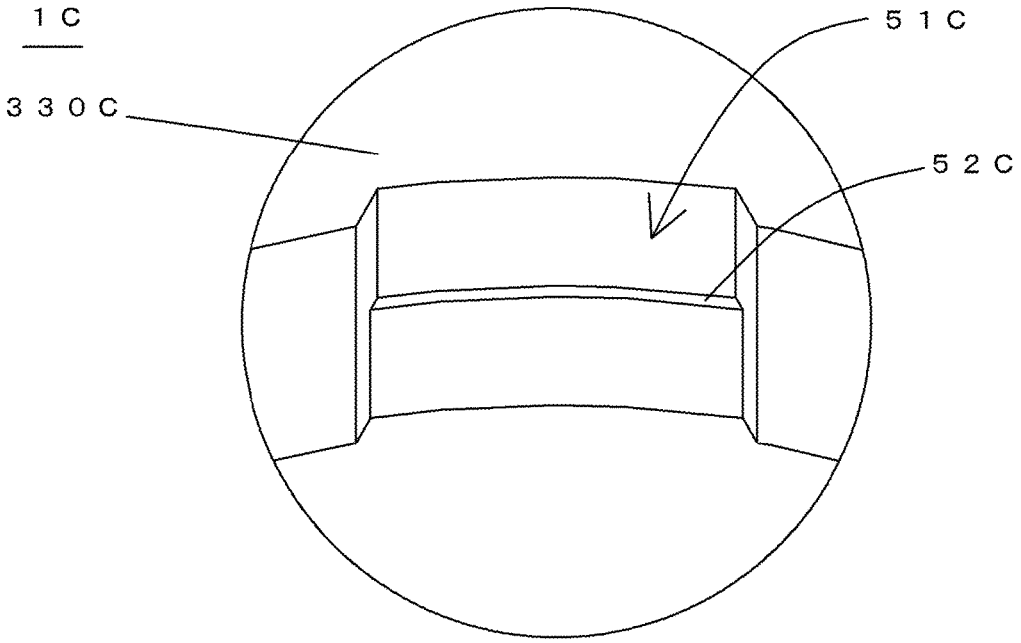
FIG. 11 is a diagram illustrating a groove portion according to yet another example modification of the above preferred embodiment in an enlarged form.

FIG. 11 is a diagram illustrating a groove portion 51C of a fan 1C according to yet another example modification of the above-described preferred embodiment in an enlarged form. The basic structure of the fan 1C according to this example modification is the same as that of the fan 1 according to the above-described preferred embodiment. Referring to FIG. 11, an upward facing surface 52C of the groove portion 51C is arranged to extend in a radial direction. A surface of the groove portion 51C axially below the upward facing surface 52C is arranged radially inward of a surface of the groove portion 51C axially above the upward facing surface 52C. Since the upward facing surface 52C of the groove portion 51C is arranged to extend in the radial direction, a wedge structure of an adhesive (not shown) is formed in the groove portion 51C, and an improvement in strength with which an impeller 330C and a rotor portion 320C are fixed to each other is achieved to reduce the likelihood that the impeller 330C will come off the rotor portion 320C.

Figure 12:
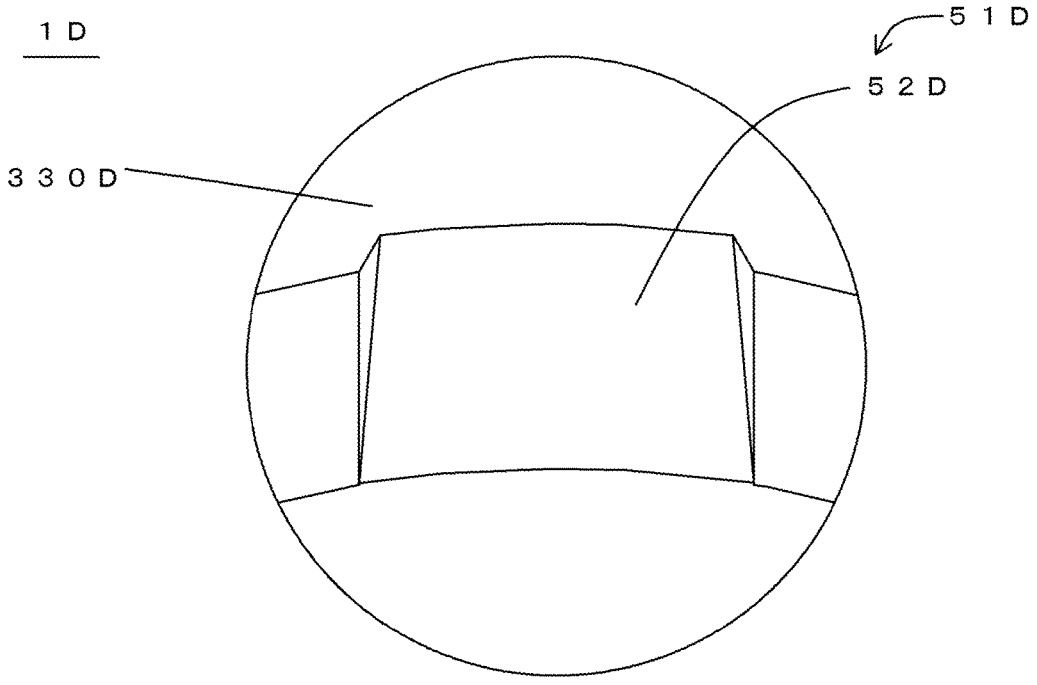
FIG. 12 is a diagram illustrating a groove portion according to yet another example modification of the above preferred embodiment in an enlarged form.

FIG. 12 is a diagram illustrating a groove portion 51D of a fan 1D according to yet another example modification of the above-described preferred embodiment in an enlarged form. The basic structure of the fan 1D according to this example modification is the same as that of the fan 1 according to the above-described preferred embodiment. Referring to FIG. 12, an upward facing surface 52D of the groove portion 51D is an inclined surface arranged to extend in a radial direction with increasing height. When the upward facing surface 52D is the inclined surface, a wedge structure of an adhesive 6D (not shown) is formed in the groove portion 51D, and an increase in strength with which an impeller 330D and a rotor portion 320D are fixed to each other is achieved. Inclination of the upward facing surface 52D makes it easier for the adhesive (not shown) to flow axially downward to sufficiently fill a bottom portion of the groove portion 51D with the adhesive (not shown). Thus, an increase in the strength with which the impeller 330D and the rotor portion 320D are fixed to each other is achieved to prevent the impeller 330D from coming off the rotor portion 320D.

Figure 13:
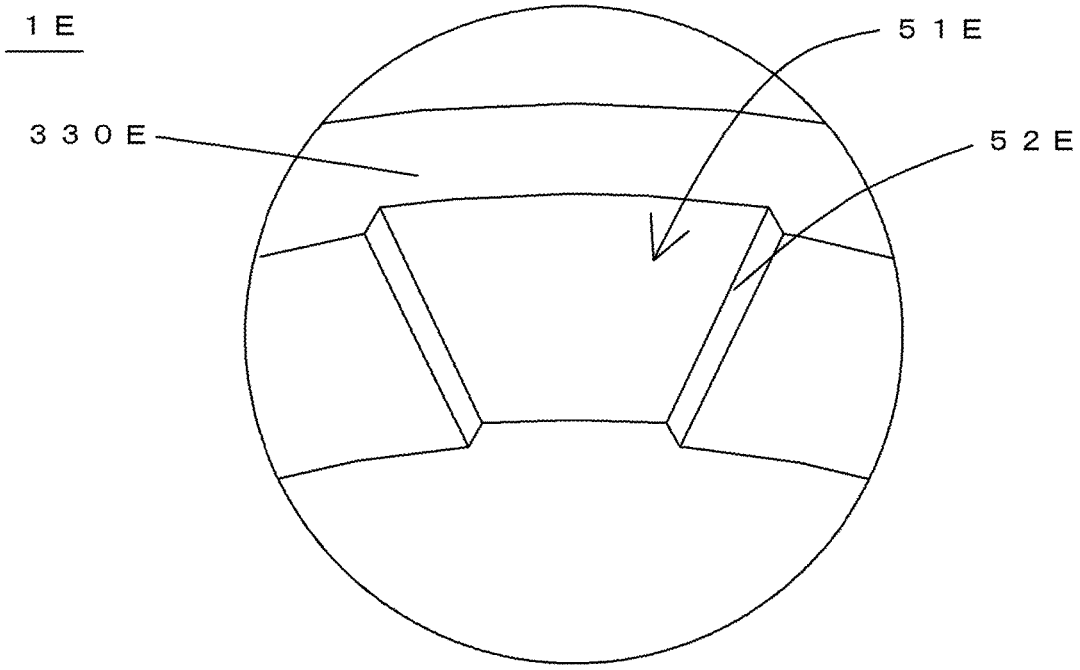
FIG. 13 is a diagram illustrating a groove portion according to yet another example modification of the above preferred embodiment in an enlarged form.

FIG. 13 is a diagram illustrating a groove portion 51E of a fan 1E according to yet another example modification of the above-described preferred embodiment in an enlarged form. The basic structure of the fan 1E according to this example modification is the same as that of the fan 1 according to the above-described preferred embodiment. Referring to FIG. 13, an upward facing surface 52E of the groove portion 51E is an inclined surface arranged to extend in the circumferential direction with increasing height. When the upward facing surface 52E is the inclined surface, a wedge structure of an adhesive (not shown) is easy formed in the groove portion 51E, and an increase in strength with which an impeller 330E and a rotor portion 320E are fixed to each other is achieved. At the same time, inclination of the upward facing surface 52E makes it easier for the adhesive (not shown) to flow axially downward to sufficiently fill a bottom portion of the groove portion 51E with the adhesive (not shown). Thus, an increase in the strength with which the impeller 330E and the rotor portion 320E are fixed to each other is achieved to prevent the impeller 330E from coming off the rotor portion 320E.

While preferred embodiments of the present invention have been described above, it is to be understood that the present invention is not limited to the above-described preferred embodiments. Note that features of the above-described preferred embodiments and the modifications thereof may be combined appropriately as long as no conflict arises.

Note that the rotor portion and the shaft may be defined by separate members. In this case, the rotor portion and the shaft are fixed to each other through an adhesive and through press fit or insertion.

Note that the plurality of blades may be arranged either at regular intervals or at irregular intervals.

Note that motors of fans according to preferred embodiments of the present invention may be either of a rotating-shaft type or of a fixed-shaft type. Also note that motors of fans according to preferred embodiments of the present invention may be either of an outer-rotor type or of an inner-rotor type.

A fan according to a preferred embodiment of the present invention may be an axial fan in which an air inlet and an air outlet are defined in an axially upper portion and an axially lower portion of a fan housing.

The preferred embodiments of the present invention and modifications thereof are applicable to spindle motors and disk drive apparatuses.

Features of the above-described preferred embodiments and the modifications thereof may be combined appropriately as long as no conflict arises.

While preferred embodiments of the present invention and modifications thereof have been described above, it is to be understood that additional variations and modifications will be apparent to those skilled in the art without departing from the scope and spirit of the present invention. The scope of the present invention, therefore, is to be determined solely by the following claims.

What is claimed is:

1. A fan comprising:

a stationary portion including a stator having coils;

a bearing mechanism; and a rotating portion supported to be rotatable about a central axis extending in a vertical direction with respect to the stationary portion;

wherein the rotating portion includes:

a rotor portion including a shaft; and an impeller including a plurality of blades and an annular impeller cup arranged to support the blades, the annular impeller cup having an innermost surface extending axially and located radially inside the stator;

wherein the rotor portion is in a shape of a covered cylinder, the rotor portion comprising: a cover portion radially outward extending from the shaft, and a cylindrical portion downward extending from the cover portion, thereby forming a space radially extending between the shaft and the cylindrical portion;

wherein the impeller is fixed to the rotor portion such that an entire circumference of an outer circumferential surface of the cylindrical portion of the rotor portion is press-fitted with the innermost surface of the annular impeller cup;

wherein at least one of the outer circumferential surface of the cylindrical portion and the inner circumferential surface of the impeller cup includes a groove portion recessed radially from the innermost surface;

wherein the groove portion includes an upward facing surface; and wherein an adhesive is arranged in the groove portion, wherein a seal portion of the bearing mechanism is arranged in the space radially inward of the innermost surface.

2. The fan according to claim 1, wherein the groove portion is provided in a plurality, and the plurality of groove portions are defined in at least one of the outer circumferential surface of the cylindrical portion and the inner circumferential surface of the impeller cup.

3. The fan according to claim 2, wherein the impeller is made of a resin material.

4. The fan according to claim 3, wherein the impeller includes a parting line defined therein;

in each groove portion, a portion of the parting line is located at a position where the groove portion has a minimum circumferential width; and at least a portion of the adhesive is arranged above the parting line.

5. The fan according to claim 4, wherein the upward facing surface of each groove portion is arranged above the parting line.

6. The fan according to claim 4, wherein each groove portion includes a downward facing surface arranged below the parting line.

7. The fan according to claim 3, wherein the impeller is molded by successive injections of the resin material;

an upper surface of the impeller cup includes a plurality of weld lines defined when the impeller is molded by the successive injections of the resin material, the weld lines being evenly distributed along a circumferential direction about the central axis in a plan view; and each groove portion is arranged at a circumferential position different from that of each weld line in the plan view.

8. The fan according to claim 2, wherein the plurality of groove portions are arranged at a substantially constant angular pitch.

9. The fan according to claim 1, wherein the upward facing surface of the groove portion is arranged to extend in a radial direction.

10. The fan according to claim 1, wherein the upward facing surface of the groove portion is arranged to extend in a circumferential direction.

11. The fan according to claim 1, wherein the upward facing surface of the groove portion is an inclined surface arranged to extend in a radial direction with increasing height.

12. The fan according to claim 1, wherein the upward facing surface of the groove portion is an inclined surface arranged to extend in a circumferential direction with increasing height.

13. The fan according to claim 1, wherein the inner circumferential surface of the impeller cup and the outer circumferential surface of the cylindrical portion of the rotor portion are fixed to each other through press fit.

14. The fan according to claim 1, wherein the rotor portion includes a flange portion arranged to be in contact with a lower surface of the impeller cup; and the upward facing surface of the groove portion is arranged above the flange portion.

15. The fan according to claim 1, wherein the bearing mechanism includes:

a cylindrical bearing portion centered on the central axis;

a bearing housing having a bottom and being cylindrical, and arranged to support the bearing portion; and a lubricating oil arranged in a gap defined between the stationary portion and rotating portion;

the bearing housing and the rotor portion are arranged to together define the seal portion therebetween; and a surface of the lubricating oil is located in the seal portion.

16. The fan according to claim 1, wherein the bearing mechanism includes:

a cylindrical bearing portion centered on the central axis; and a bearing housing having a bottom and being cylindrical, and arranged to support the bearing portion;

at least one of an outer circumferential surface of the shaft and an inner circumferential surface of the bearing portion includes a radial dynamic pressure generation portion; and the innermost surface is arranged to radially overlap with the radial dynamic pressure generation portion.

17. The fan according to claim 1, wherein the bearing mechanism includes:

a cylindrical bearing portion centered on the central axis; and a bearing housing having a bottom and being cylindrical, and arranged to support the bearing portion;

at least one of a lower surface of the cover portion and an upper surface of the bearing portion includes a thrust dynamic pressure generation portion; and the innermost surface is arranged to radially overlap with the thrust dynamic pressure generation portion.

18. The fan according to claim 1, wherein the groove is located radially inside the stator.

* * * * *